US009265319B1

(12) United States Patent
Zeh-Franke

(10) Patent No.: US 9,265,319 B1
(45) Date of Patent: Feb. 23, 2016

(54) PURSE AND HANDBAG ORGANIZER WITH INTEGRAL FIREARM HOLSTER

(71) Applicant: Kristen K. Zeh-Franke, Cape Coral, FL (US)

(72) Inventor: Kristen K. Zeh-Franke, Cape Coral, FL (US)

( * ) Notice: Subject to any disclaimer, the term of this patent is extended or adjusted under 35 U.S.C. 154(b) by 26 days.

(21) Appl. No.: 14/145,595

(22) Filed: Dec. 31, 2013

Related U.S. Application Data

(60) Provisional application No. 61/849,383, filed on Jan. 25, 2013, provisional application No. 61/853,501, filed on Apr. 8, 2013.

(51) Int. Cl.
*A45C 13/02* (2006.01)

(52) U.S. Cl.
CPC ..... *A45C 13/02* (2013.01)

(58) Field of Classification Search
CPC ..... A45C 13/02; F41C 33/02; F41C 33/0209
USPC ..... 224/911; 150/101.106
See application file for complete search history.

(56) References Cited

U.S. PATENT DOCUMENTS

| | | | | | |
|---|---|---|---|---|---|
| 2,529,724 | A * | 11/1950 | Conwiser | 150/113 |
| 2,620,005 | A * | 12/1952 | Hall | 150/113 |
| 2,810,132 | A * | 10/1957 | Nicholson | 2/247 |
| 3,347,299 | A * | 10/1967 | Velda | 150/113 |
| 3,543,825 | A * | 12/1970 | Dobbs | 150/113 |
| 4,138,044 | A * | 2/1979 | Musgrave | 224/242 |
| 4,645,103 | A * | 2/1987 | Bianchi et al. | 224/243 |
| 4,811,769 | A * | 3/1989 | Phares | 150/113 |
| 5,170,919 | A * | 12/1992 | DeSantis et al. | 224/587 |
| 6,131,198 | A * | 10/2000 | Westrick | 2/102 |
| 8,936,150 | B1 * | 1/2015 | Whaley | 206/317 |
| 2011/0185477 | A1 * | 8/2011 | Olenicoff | 2/247 |
| 2013/0175309 | A1 * | 7/2013 | King | 224/576 |

* cited by examiner

*Primary Examiner* — Sue A Weaver
(74) *Attorney, Agent, or Firm* — William E. Noonan

(57) ABSTRACT

An organizer device for holding and concealing a firearm within the main interior compartment of a bag includes a bag insert for being received by and fitting within the main compartment of the bag. The insert includes a peripheral wall surrounding a main receptacle of the insert. A holster is attached to the peripheral wall and has an interior holster chamber and a closure for selectively closing and opening the holster chamber. A holster pouch is removably received and supported within the holster chamber. The holster pouch has an interior space for receiving the firearm. The interior space is configured to generally conform to a peripheral shape of the firearm such that movement of the firearm within the interior cavity of the holder insert is constrained.

18 Claims, 5 Drawing Sheets

PURSE AND HANDBAG ORGANIZER WITH INTEGRAL FIREARM HOLSTER

RELATED APPLICATIONS

This application claims the benefit of U.S. Provisional Application Ser. No. 61/849,383 filed Jan. 25, 2013 and U.S. Provisional Application Ser. No. 61/853,501 filed Apr. 8, 2013.

FIELD OF THE INVENTION

This invention relates to an organizer device for carrying bags such as purses, handbags, backpacks, pocketbooks, briefcases and the like. The organizer device includes an integral holster for a concealed firearm.

BACKGROUND OF THE INVENTION

Personal safety and security concerns have caused many persons to carry concealed firearms and other types of crime deterrent devices such as chemical mace. In particular, women have been increasingly apt to carry a concealed weapon on their person. However, often times the construction or style of a woman's clothing does not permit proper concealment of the firearm. In addition, a concealed handgun cannot be safely or comfortably carried in many if not most types of women's apparel. Such a weapon is also likely to be awkward, time consuming and inconvenient to access when needed.

Many women carry a bag of some sort, such as a purse, handbag, pocketbook, etc. to store and carry items such as keys, money, a driver's license, credit cards and assorted personal items. However, these types of containers are usually inappropriate for carrying a concealed firearm. Many handbags are sizeable and filled with a variety of items. A handgun or similar weapon is typically fairly heavy and is likely to fall to the bottom of the bag. It can also become mixed with and potentially misplaced within other items carried in the bag. As a result, the firearm may be difficult and time consuming to locate, which is very undesirable in an emergency situation. The owner of the firearm may have to fumble around and search through the bag in order to locate and retrieve the weapon.

Although many purses and handbags do include individual pockets and compartments, these remain largely unsatisfactory for use in storing a concealed firearm. For one thing, the pockets and compartments in conventional handbags and purses are not specially designed or dedicated for use in holding a concealed firearm. They may be filled with change and other miscellaneous items that again can interfere with prompt location and retrieval of the firearm. Moreover, it is quite significant that the storage compartments in existing bags and purses are not properly configured to secure the firearm in a static orientation within the bag. Rather, the position of the firearm is likely to shift and move as the bag or purse is being carried. Not only can this further disorganize the contents of the purse, it can also impede the owner's ready access to the firearm in the event of an emergency. Moreover, if the firearm is not held in a perfectly static condition within the purse, with the barrel of the firearm pointing in a downward direction, serious and potentially deadly safety hazard may result. If the firearm shifts position while the bag is carried, the barrel of the firearm may turn and point upwardly or at some other angle that may be extremely dangerous to the owner or passersby in the event that the firearm accidentally discharges inside the bag.

I have determined that a significant need exists for a means to conveniently carry firearms of various sizes in a concealed, yet secure, safe and organized manner within virtually any conventional purse, handbag or similar item. I have further determined that it is critical that the firearm be constrained in a static position within the handbag so that it does not move during transport and create the safety hazard described above. The organizer should be constructed so that the firearm may be quickly, conveniently and effectively accessed in the event of an emergency.

SUMMARY OF THE INVENTION

It is therefore an object of the present invention to provide an organizer device for conveniently, securely and safely holding a concealed weapon within a conventional purse, handbag, backpack, pocketbook or other type of carrying bag.

It is a further object of this invention to provide an organizer device that fits conveniently and attractively within various types of carrying bags and which allows both a concealed weapon and various other items to be neatly and conveniently organized within the bag.

It is a further object of this invention to provide an organizer for a handbag or similar item, which securely holds a concealed firearm and which permits quick and convenient access to the firearm in the event of an emergency.

It is a further object of this invention to provide a person handbag organizer with an integral firearm holster that can be uniquely conformed to the shape of various types of firearms so that the concealed firearm is held in a static and safe position within the bag.

It is a further object of this invention to provide a person handbag organizer with an integral firearm holster that holds the concealed firearm in a stationary and easy to locate position within the bag so that the firearm is readily accessible if needed and is secured with its barrel in a downwardly pointing position to reduce the risk of personal injury or death in the event of an accidental discharge of the firearm within the bag.

It is a further object of this invention to provide an organizer that minimizes shifting and other movement of a concealed weapon within a carrying bag as the bag is being carried so that the firearm is quickly and readily accessible, as needed, and so that the firearm is held securely in a downwardly pointing direction to reduce the risk of injury or death in the event of an accidental discharge of the firearm within the bag.

This invention features an organizer device for holding and concealing a firearm within the main interior compartment of a bag, which bag may include a purse, handbag, backpack, pocketbook, briefcase or like item. The organizer device includes a bag insert for being received by and fitting within the main compartment of the bag, the bag insert includes a peripheral wall that surrounds a main receptacle of the insert. A holster is attached to the peripheral wall of the insert. The holster has an interior holster chamber and preferably features a closure for selectively closing and opening the holster chamber. A holster pouch is preferably removably inserted and supported within the holster chamber. The holster pouch has an interior space for receiving the firearm to be held by the organizer. The interior space is configured to generally conform to at least a portion of the peripheral shape of the firearm. As a result, movement of the firearm within the interior space of the holster pouch is constrained.

In a preferred embodiment, the insert may include an open upper end that communicates with the main receptacle and a bottom that extends beneath and is attached to the peripheral wall. The peripheral wall may carry at least one pocket spaced apart from the holster for accommodating respective items therein. Indicia such as a ribbon may mark the one or more pockets to facilitate visual location thereof.

The holster chamber may include a first corner and the holster pocket may include a substantially conformably shaped second corner for interengaging the first corner to constrain movement of the holster pouch within the holster chamber. The holster pouch may include a curved edge opposing the second corner. The curved edge may include an access opening formed therein, which access opening communicates with the interior space of the holster pouch for introducing the firearm into and removing the firearm from the interior space of the holster pouch. The outside surface of the pouch and inside surface of the holster chamber may include complementary sections that are frictionally interengageable to hold the holster pouch within the holster chamber when the firearm is retrieved from the holster.

The holster may extend above the peripheral wall of the container. The holster may include an entrance and the closure may include complementary fastening elements connected to the holster on respective opposite sides of the entrance. In certain embodiments, one of the fastening elements is carried by a flap that is itself flexibly connected to the holster. The complementary fastening elements are interengaged to close the entrance into the holster chamber and disengaged to open the entrance into the holster chamber. In versions utilizing the closure flap, the flap selectively uncovers the entrance to open the holster and covers the entrance to close the holster. One of the complementary fastening elements may be attached to the flap for engaging the other fastening element and holding the entrance closed when the flap covers the entrance. Preferably, the complementary fastening elements include complementary magnetic components. Alternative means of attachment (i.e. Velcro, snap fasteners) may be utilized, although magnets are preferred for quicker and more convenient accessibility to the holster pouch and the accommodating firearm. The space in the holster insert may be configured for directing the barrel of a firearm held in the pouch downwardly. This prevents the firearm from shifting its position within the holster and thereby reduces the risk of accidental injury or death if the firearm accidentally discharges within the bag.

The invention further features an assembly including the combination of a firearm and an organizer, as previously described, for holding and concealing a firearm within the main compartment of a bag. This invention also features an integrated bag, insert and firearm holster assembly including a bag having a main interior compartment for receiving, holding and transporting items and an organizer device, as previously described, for holding and concealing a firearm within the main interior compartment of the bag.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
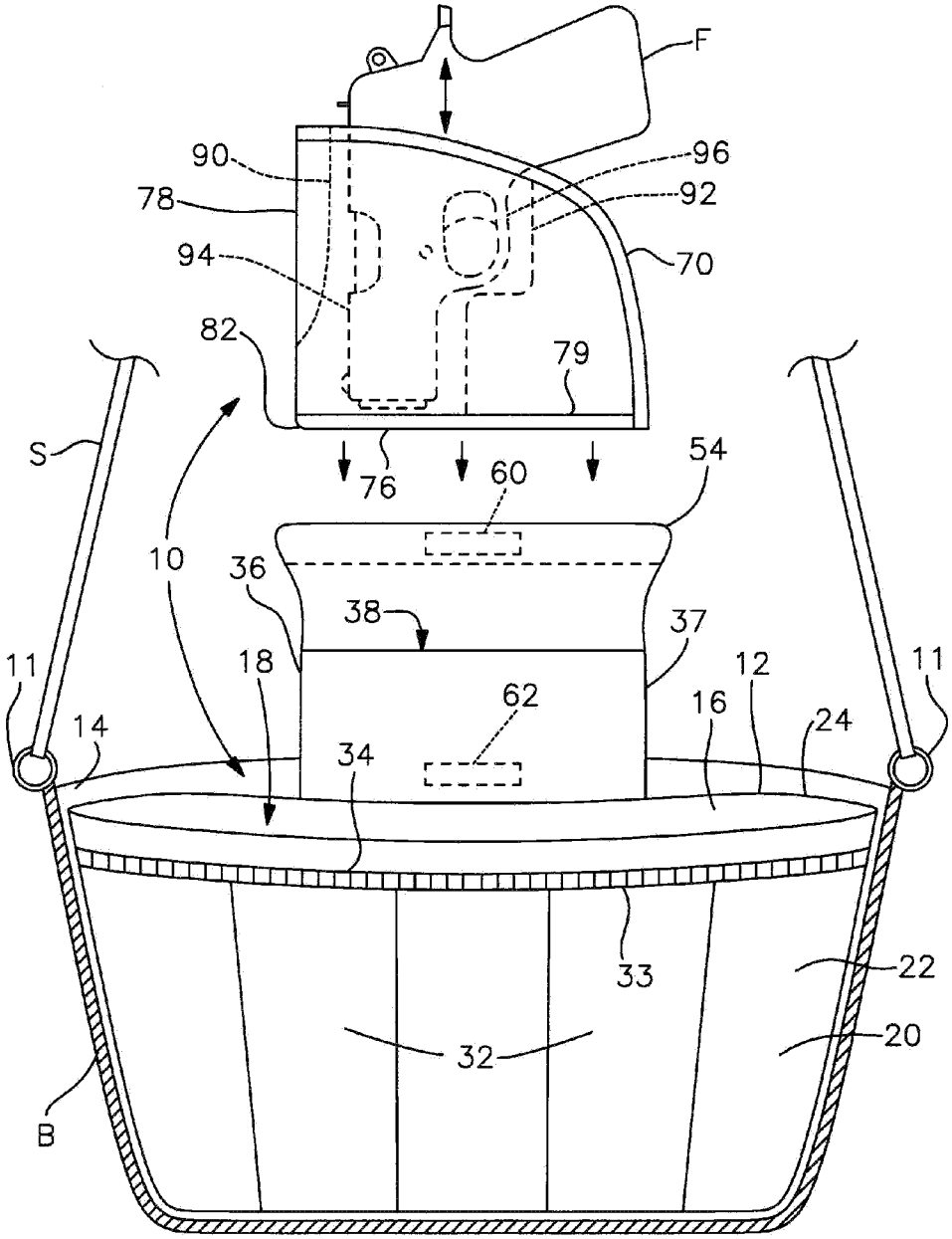
FIG. 1 is an elevational, partly cross sectional front view of the organizer device of this invention mounted within a carrying bag with a holster pouch and concealed weapon positioned above the open holster of the organizer.

There is shown in FIG. 1 an organizer device 10 for holding and concealing a firearm F within a bag B. As used herein, "bag" should be understood to refer to virtually any and all makes, models, brands and types of carrying bags including, but not limited to purses, handbags, pocketbooks, backpacks, knapsacks, briefcases and the like. The type of bag with which organizer 10 is used should not be considered a limitation of this invention. It is simply required that the bag include a compartment, referred to herein as "main compartment" for receiving and fitting the organizer therein. In the version depicted in FIG. 1, bag B features a shoulder strap S that is secured to the bag by rings 11 mounted in the bag in a conventional manner. In alliterative versions, the bag may more closely resemble a purse or pocketbook that does not include a shoulder strap. In some versions, the bag may simply include one or two handles; it may alternatively lack any type of strap or handle whatsoever. It should also be understood that firearm F may comprise various types of handguns including but not limited to revolvers, compacts, subcompacts, etc. "Firearms" should also be considered to include protective or defensive implements such as pepper spray, tasers or mace. As will be described more fully below, the holster and, more particularly, the holster pouch is specifically configured for statically accommodating respective types, brands and sizes of firearms. The organizer of this invention is appropriate for use with virtually any type of weapon that discharges a bullet or other form of projectile, including but not necessarily limited to items for which concealed firearm permits are required. The organizer and integrated holster of this invention should be construed to cover all such firearms and defensive implements and the particular type of firearm or similar item with which the device is used should not be considered a limitation of this invention.

Figure 2:
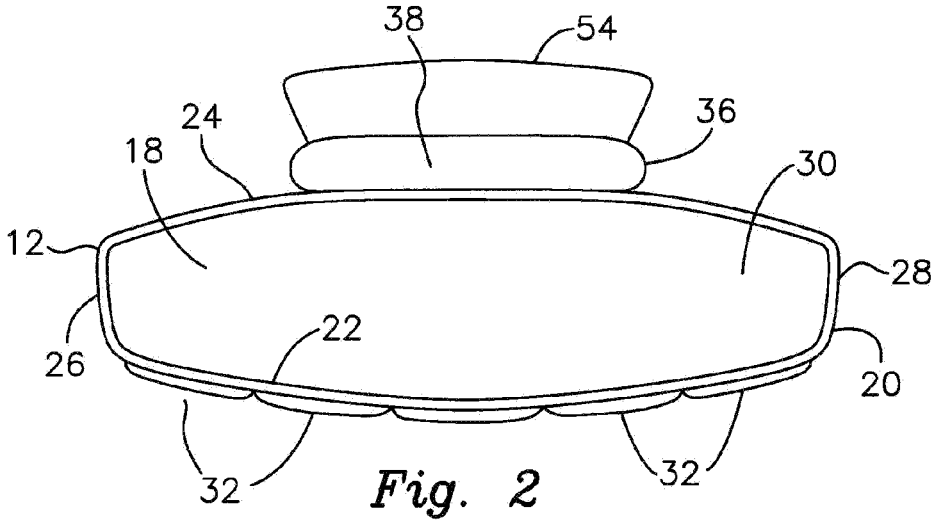
FIG. 2 is a top plan view of the bag insert and integral open holster of the organizer device.
Figure 3:
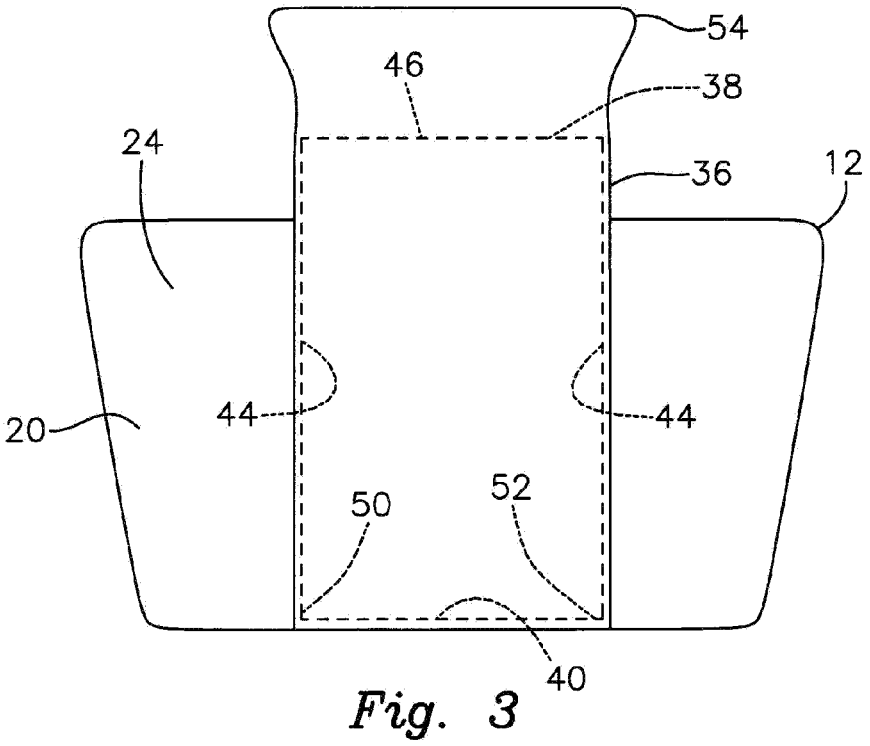
FIG. 3 is an elevational rear view of the bag insert and integral open holster.
Figure 4:
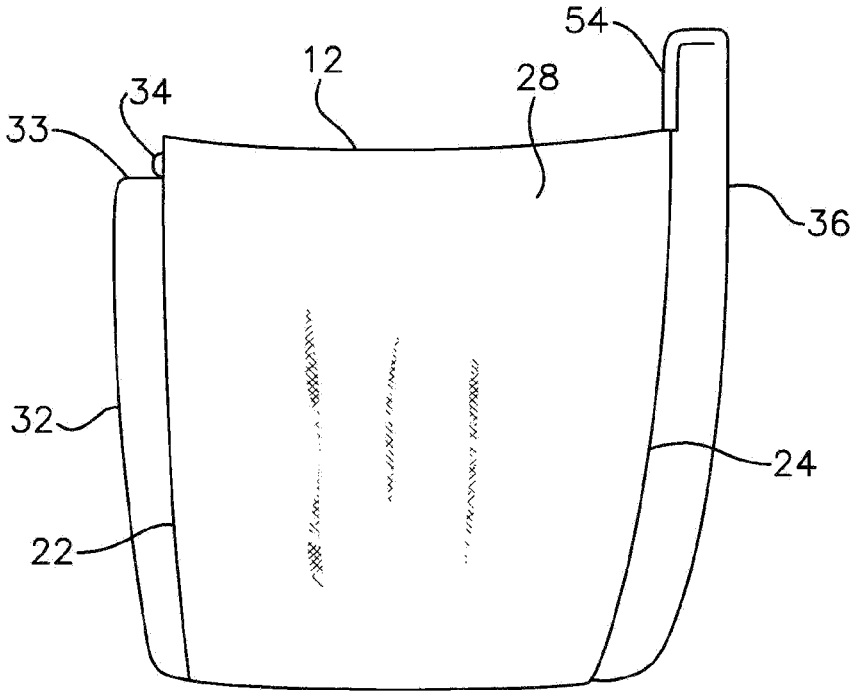
FIG. 4 is an elevational side view of the standard organizer with the holster flap in a closed condition.

Organizer 10 includes a bag insert 12 for being received by and fitting within the main compartment 14 of bag B. Bag insert 12, which is also shown in FIGS. 2-4, can have a variety of shapes, sizes and dimensions which permit it to fit more or less conformably, securely and attractively within the main compartment of the bag. Insert 12 is preferably composed of a strong yet flexible material that is able to generally conform with the interior shape of various types of bags, yet includes a somewhat rigid, self-sustaining shape for securely supporting the concealed firearm. More particularly, the bag insert as well as the other components of the invention which are described below, may include a heavy duty cotton fabric. The insert may include separate pieces that are sewn or otherwise joined together or it may comprise a single piece of material. The fabric may be superposed over adhesively bonded to and reinforced by flexible, yet shape sustaining interior pieces of stiffening fabric comprising, for example, Pellon part nos. 72F and (for the version of FIG. 8) 808. It should be understood, however, that the precise materials and manufacturing techniques used in constructing the bag insert and other components to the organizer may be varied and substituted within the scope of this invention and should be understood by persons skilled in the art.

Insert 12 includes an open upper end 16 that communicates with an interior receptacle 18. Receptacle 18 is surrounded and defined by a peripheral wall 20 which includes forward and rear wall sections 22 and 24, and side wall sections 26 and 28, respectively. A bottom piece 30 is joined to the peripheral wall 20 and defines a floor of the insert 12. Each of the wall sections 22, 24, 26 and 28 may comprise separate pieces that are sewn or otherwise connected together. Alternatively, the peripheral wall may be constructed as a single unitary piece.

As shown in FIGS. 1, 2 and 4, pockets 32 are secured to the outside surface of front wall section 22. Each pocket 32 extends vertically for most of the height of peripheral wall 20. Various numbers and arrangements of pockets 32 may be employed. Each pocket 32 is open along its upper edge to provide access for various items such as keys, change, personal papers, jewelry etc. The pockets allow for such items to be organized conveniently within bag B so that the respective items do not become mixed and jumbled. Individual items are thereby more readily accessible within the bag. Additional items and particular larger items such as packages, books, etc. may be stored in larger main receptacle 18. The pockets are typically constructed of durable cotton or a similar fabric as is used for the container 12 itself. The pockets are stitched, sewn or otherwise attached to the outer surface of wall section 22 in a conventional manner. An elongate ribbon 34 is stitched or otherwise attached to front wall 22 such that ribbon 34 extends laterally across the front wall just above the upper openings 33 of pockets 32. Ribbon 34 includes a distinctive design or pattern or colors such as alternating color segments. This allows the user to quickly and conveniently locate the pockets within bag B as needed.

As best depicted in FIGS. 3 and 4, a holster 36 extends from the lower edge of rear wall portion 24 to a height somewhat above the upper edge of rear wall section 24. The precise location of the bottom and top ends of holster 36 may be varied within the scope of this invention. Holster 36 includes an interior holster chamber 38, best depicted in FIG. 2, which is sized to accommodate the holster pouch and concealed firearm as described below. More particularly, the holster chamber includes a generally horizontal bottom edge 40, FIG. 3, a pair of vertical side edges 42 and 44 and an upper entrance 46. The side edges may be tapered slightly from top to bottom in alternative versions. In any event, the side edges 42, 44 and the bottom edge 40 define a pair of lower corners 50 and 52 of holster chamber 38. The significance of this configuration is described more fully below.

Holster 36 also includes a closure flap 54 that is unitarily and foldably carried by holster 36 proximate the upper open end 46 of holster chamber 40. In certain embodiments, the holster may comprise a pair of fabric pieces that are stitched together along their edges and then attached to the back wall portion 24 of the insert such that the holster chamber 40 is formed between the two sewn together pieces of the holster. Alternatively, the holster 36 may comprise a single piece of fabric that is attached unitarily (in one piece), integrally or directly to the back wall of the bag insert such that the holster chamber is formed between the back wall 24 and the single piece of fabric comprising holster 36. The former version is preferred and is shown in the embodiment described herein. Various other ways of incorporating the holster into or attaching the holster to the insert may be employed within the scope of this invention. Closure flap 54 may be alternated between the open condition shown in FIGS. 1, 2 and 3 and the closed condition shown in FIG. 4. In the open flap condition, holster chamber 38 is exposed so that a holster pouch 70 and accommodated concealed firearm may be introduced into or removed from the holster chamber as shown in FIG. 1 and in the manner described more fully below. When the holster pouch and accommodated firearm are inserted within the chamber of holster 36, the flap 54 is closed as shown in FIG. 4.

A pair of complementary fastening elements comprising magnetic components 60 and 62 further facilitate closure of holster 36. A first magnetic component 60 is carried by flap 54 proximate the upper edge of the flap. A complementary second magnetic component 62 is similarly carried by the forward piece 37 of holster 36 above the upper edge of bag insert 12. Magnetic components 60 and 62 may be secured to the holster by various means. For example, the magnetic components may be inserted into respective pockets that are sewn in the fabric of the holster. When flap 54 is closed, as shown in FIG. 4, the complementary magnetic components 60 and 63 adhere to one another so that the flap is held in the closed condition shown in FIG. 4. The magnetic components are selected so that they may be selectively disengaged from one another to open holster 36 by exerting a minimally convenient degree of force to pull the magnetic components apart.

In alternative embodiments, various other types of closures may be employed for the holster. For example, Velcro, snap fasteners and other forms of fasteners may be utilized, although magnets are particularly preferred to facilitate quick and convenient access to a firearm stored in the holster. In still other versions, the flap may be eliminated and the upper edges of the holster may include a slit that is selectively opened to access the holster pocket. In such cases, magnets or other fastening elements may be provided along opposite sides of the slit and carried by respective pieces of fabric forming the holster.

As previously indicated, concealed firearm F is received in a holster pouch 70 which, in turn, is inserted into the holster chamber 38 of holster 36. Holster pouch 70, which is further shown in FIGS. 5 and 6, is, once again, constructed of a heavy duty cotton or synthetic fabric. More particularly, the insert includes a pair of substantially conformably shaped pieces of fabric 72 and 74. Each piece includes a pair of horizontal and vertical edges 76 and 78 respectively that are interconnected by a curved or arcuate edge 80. Edges 76 and 78 form a lower second corner 82 that is perpendicular or virtually perpendicular such that it conforms with previously described first corner 50 of holster chamber 38, see FIG. 3. The matching corners 50 and 82 restrict pouch 70 from rotating within holster chamber 38. By the same token, lower edge 76 of pouch 70 has a length that is slightly less than or generally equivalent to the length of the bottom edge 40 in holster chamber 38. This helps to prevent lateral shifting of the holster pouch within the holster chamber as is described more fully below.

Figure 5:
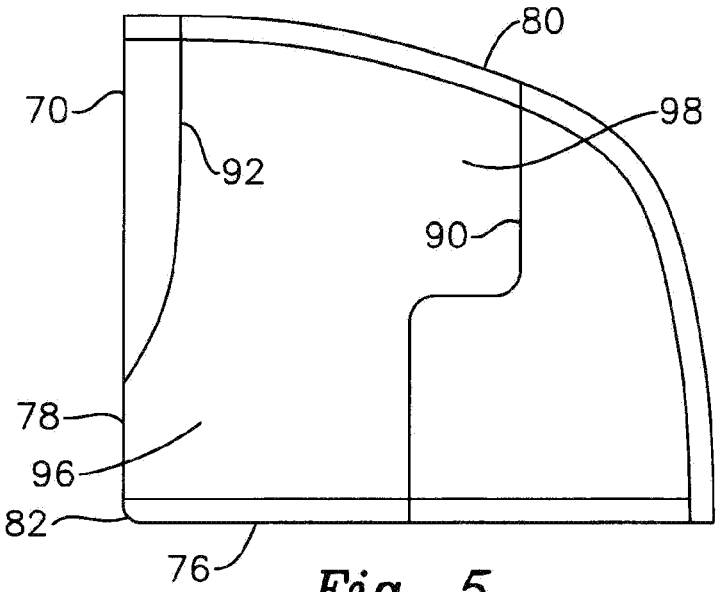
FIG. 5 is an elevational front view of a preferred holster pouch in accordance with this invention.
Figure 6:
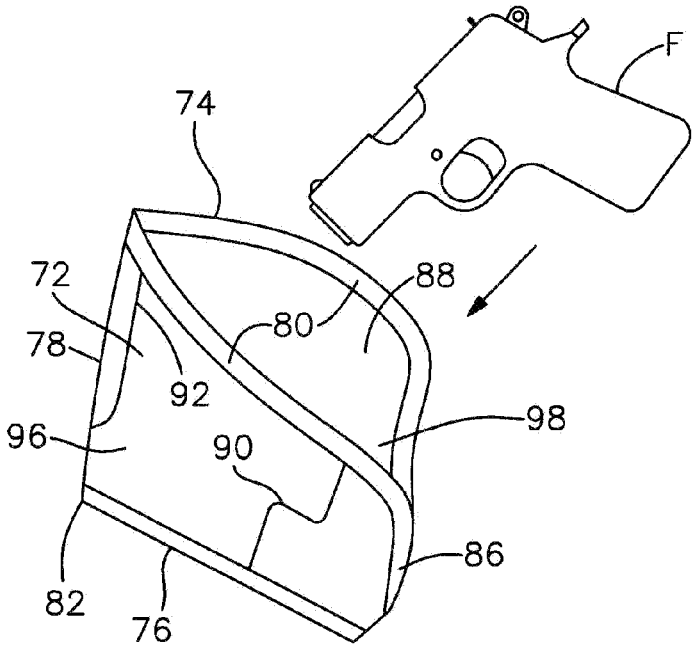
FIG. 6 is a perspective view of a firearm being inserted into the open holster pouch.

Fabric pieces 72 and 74 of pouch 70 are sewn, stitched or otherwise joined along respective edges 76 and 78 and along a lower segment 86 of conformably curved edges 80. As described further below, the stitched edges 76, 78 form a seam 79 that frictionally interengages the inside fabric surface of holster chamber 38 to hold the holster pouch securely in the holster chamber when the user retrieves firearm F. The remainder of the conforming arcuate edges 80 is left open or detached to form an open interior space 88 within pouch 70, as best shown in FIG. 6. The shape of interior space 88 is in part defined by the stitched or seamed edges 76 and 78 of the insert. The configuration of the interior space is further and critically defined by additional transverse stitching such as 90 and 92 formed across the pieces of fabric 72, 74 defining the pouch. This internal stitching defines the shape of interior space 88 so that it generally conforms to the peripheral shape of a firearm F to be accommodated and concealed in the interior space 88 of pouch 70. In particular, as shown in FIGS. 1, 5 and 6, the interior space includes a first section 94 generally conforming to the barrel of the firearm and a second section 96 generally conforming to the shape of the firearm grip. As used herein, "generally conforming" should be understood to mean that the shape of interior space of the holster pouch matches at least a portion of the peripheral shape (e.g. the barrel and trigger guard) of the firearm sufficiently to restrict or constrain the firearm from rotating or moving significantly within the interior space 88 of pouch 70. Essentially, the configuration of the shape prevents the firearm from re-orienting its position within the pouch while the pouch is being carried within the holster. The grip is positioned outside pouch 70 and conveniently accessible to the user.

Figure 7:
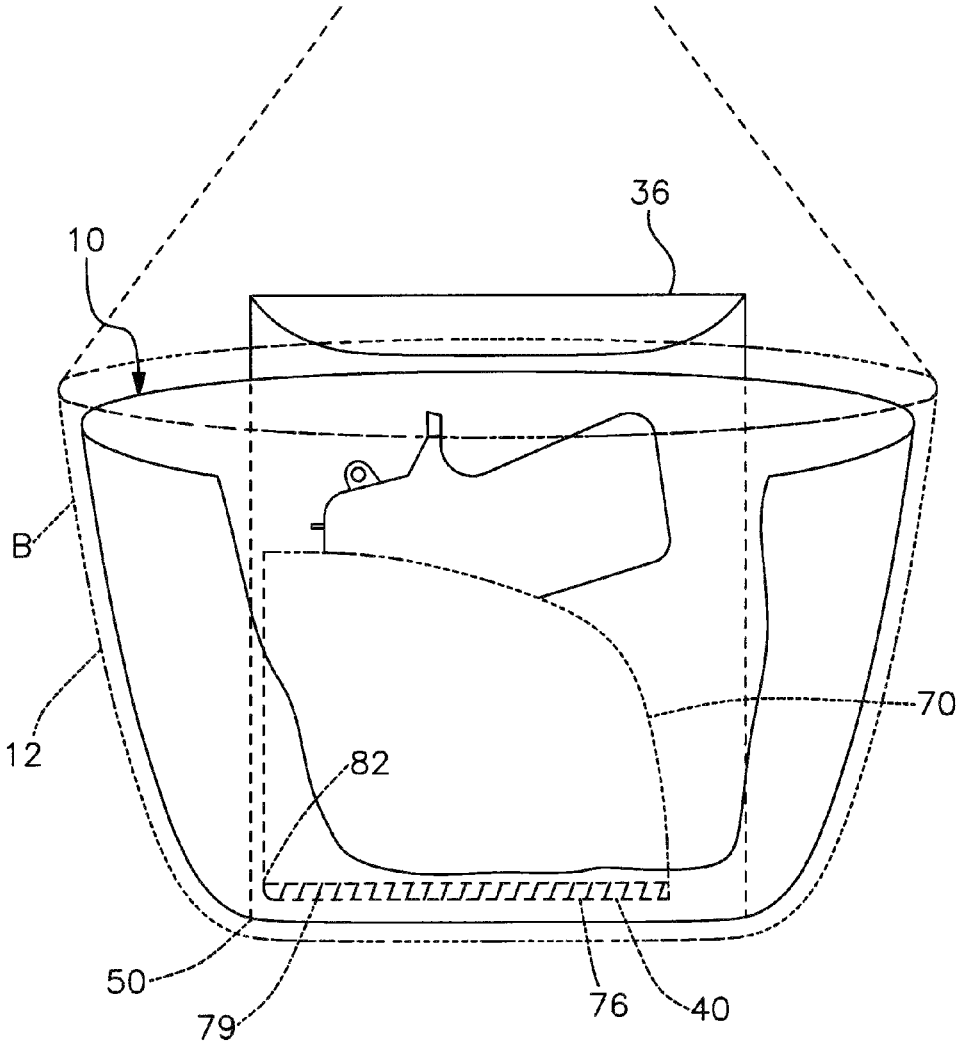
FIG. 7 is a front perspective view of the organizer positioned within a handbag, which is shown in phantom; the holster pouch and accommodated firearm are received in the holster chamber.

FIG. 7 depicts the organizer 10 within bag B. As previously indicated, the holster 36 and its interior holster chamber include vertical side edges. Holster pouch 70 is shown received within the holster chamber. Pouch 70, is shown accommodating firearm F within a generally conformably-shaped interior space, including the positioning corner, that generally conforms to the shape of corner 50 in the chamber of holster 36.

As previously explained, the length of lower edge 76 of insert 70 is slightly less than the length of the interior chamber of holster 36. As a result of the conforming corners 50 and 82 (FIG. 1) and the roughly equivalent widths of the holster chamber and holster pouch, the pouch is constrained from rotating or significantly shifting laterally within the holster chamber. This, in combination with the generally conforming shapes of the firearm and the pouch of the holster insert effectively restricts the firearm from moving within the organizer and bag and holds the firearm stationary with its barrel pointing in a downward direction within the bag.

The organizer 10 is utilized by installing bag insert 12 into bag B. As previously indicated, the organizer may have various dimensions to accommodate different types of bags. The user may organize the bag effectively by placing various items in the respective pockets and main compartment of the organizer. A firearm F is then introduced into a pouch 70 that is sized and configured to generally conformably receive that firearm. In particular, the pouch is opened as shown in FIG. 6 and the firearm is introduced into the interior space 88 of the pouch 70. The firearm is thereby constrained from moving within the pouch. The pouch and concealed firearm are then introduced into the holster 36 by opening flap 54 and introducing pouch 70 into the interior chamber 38 of the holster. As previously described, the holster pouch assumes a position within the holster chamber such that the insert and concealed firearm cannot rotate, turn or substantially shift position in a lateral direction within the organizer due to the conformance of corners 50 and 82 and the close dimensions of bottom edges 76, 40. The weight of items carried in the main receptacle and pockets of the container insert further help to maintain the concealed weapon in a static, secure and safe position and orientation. Due to the above described construction, the firearm is constrained to point downwardly as shown in FIGS. 1 and 7. In the event of an accidental discharge of the firearm, there is much less risk of a person being seriously injured. The exposed grip remains stable and readily accessible to the user in the event the firearm is needed for an emergency or otherwise. When the firearm is retrieved, the stiffener or fabric material comprising seam 79 frictionally interengages the fabric forming the inside surface of the holster chamber 36. This holds the holster pouch securely within the holster when the firearm is retrieved so that the pouch does not interfere with retrieval and possible use of the firearm.

Figure 8:
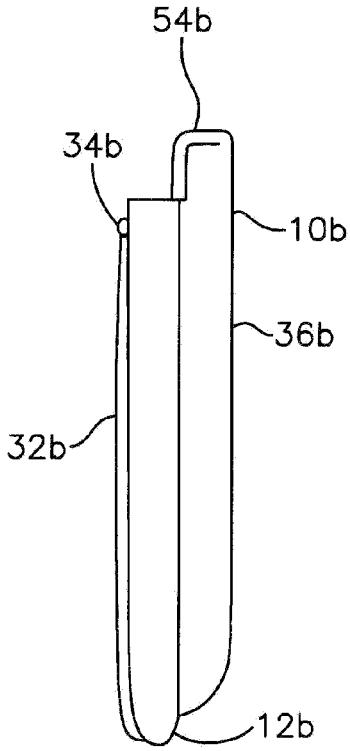
FIG. 8 is an elevational side view of an alternative organizer device in accordance with this invention wherein the bag insert is relatively thin or slim for use in a thin bag or divided purse.

FIG. 8 depicts an alternative embodiment of this invention wherein organizer 10*b* includes a slim or thin bag insert 12*b* designed adapted for being received in a divided purse or slim contained bag area. Once again, one or more pockets 32*b* are carried by the front of the container insert and a marking ribbon 34*b* indicates the location of these pockets. A holster 36*b* as previously described, with its flap 54*b* closed is attached to a back wall of bag insert 12*b*. Other than the narrow front to rear depth of the bag insert, organizer 10*b* is constructed and operates analogously to that of the previously described embodiments.

Various other modifications and alterations may be made to the previously described embodiments within the scope of this invention. The individual pieces and components may be interconnected unitarily or in one piece rather than sewn or stitched as described. As indicated, the insert pouch may include various interior configurations for accommodating various makes and models of firearms, as well as canisters of pepper spray, mace, taser etc. In all cases, it is important that the configuration of the interior pouch of the holster insert, as well as the respective configurations and dimensions of the holster chamber and holster insert be such that the concealed firearm is held in a static, secure and safe position within the organizer and within the bag as a whole.

The organizer may be reversible such that when the bag insert and its peripheral wall are turned inside out, the pockets are positioned along the interior surface of the peripheral wall. In that case, the holster will likewise be secured along the interior surface of the peripheral wall and will be effectively located in the main receptacle of the bag insert.

The organizer preferably has a height of approximately 8 inches. The length may vary from 9 inches to 12 inches and the width may vary from 1½ inch (version of FIG. 8) to 5 inches (the version of FIGS. 1-7). These configurations are representative only, and may be varied within the scope of this invention. The interior space of the holster pouch may have various configurations to accommodate various types of concealed weapons. For example, perspective configurations may be provided for compact and subcompact handguns, revolvers and other weaponry such as taser, pepper spray and mace.

Accordingly, the organizer of the present invention allows a firearm to be concealed effectively within a purse, handbag, pocketbook, backpack, knapsack, briefcase or other type of bag or carrying implement. Not only does the organizer hold the firearm securely, safely and out of sight, it also permits prompt and reliable location of and access to the firearm in the event it is needed. The organizer also helps to keep the bag neatly and attractively organized and optimizes the full functionality of the bag. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. An organizer device for holding and concealing a firearm within a main interior compartment of a bag, said organizer device comprising:

a bag insert for being received by and fitting within the main compartment of the bag, said bag insert including a peripheral wall that surrounds a main receptacle of said bag insert;

a holster attached to said peripheral wall of said bag insert, said holster having an interior chamber for receiving the firearm; and a holster pouch removably received in said holster chamber and having an interior space for holding the firearm and being configured for generally conforming to a peripheral shape of at least a portion of the firearm such that movement of the firearm within said holster pouch is constrained.

2. The device of claim 1 in which said bag insert includes an open upper end that communicates with said main receptacle and a bottom that extends beneath and is attached to said peripheral wall.

3. The device of claim 1 in which said peripheral wall carries at least one pocket spaced apart from said holster for accommodating respective items therein.

4. The device of claim 3 further including indicia that mark said at least one pocket to facilitate visual location thereof.

5. The device of claim 1 in which said holster chamber includes a first corner and said holster pouch includes a substantially conformably shaped second corner for interengaging said first corner to constrain movement of said holster pouch within said holster chamber.

6. The device of claim 5 in which said holster pouch includes bottom and side edges that join to form said second corner and a curved edge interconnecting said bottom and side edges, said curved edge having an access opening into said interior space of said holster pouch for introducing the firearm and into and removing the firearm from said holster pouch.

7. The device of claim 1 in which said holster extends above said peripheral wall.

8. The device of claim 1 in which said holster has a closure for selectively opening and closing said holster chamber.

9. The device of claim 8 in which said holster chamber includes an entrance and said closure includes a flap flexibly attached to said holster for selectively uncovering said entrance to open said holster chamber and covering said entrance to close said holster chamber.

10. The device of claim 9 in which said closure includes complementary fastening elements carried by said flap and said holster that are selectively interengageable to close said holster chamber; said fastening elements being disengaged for opening said holster chamber.

11. The device of claim 1 in which an outer surface of said holster pouch and an inner surface of said holster chamber include complementary sections that are frictionally interengageable to hold said holster pouch securely in said holster chamber when the firearm is removed from said holster pouch.

12. The device of claim 1 in which said interior space of said holster pouch is configured for directing the barrel of a firearm held in said holster pouch downwardly when said holster pouch is received in said holster chamber.

13. An assembly including a firearm and an organizer for holding and concealing the firearm within a main compartment of a carrying bag, said assembly comprising:

a firearm;

a bag insert for being received by and fitting within the main compartment of the carrying bag, said bag insert including a peripheral wall that surrounds a main receptacle of said bag insert;

a holster attached to said peripheral wall of said bag insert, said holster having an interior holster chamber and a closure for selectively closing and opening said holster chamber; and a holster pouch removably inserted and supported within said holster chamber, said holster pouch having an interior space for receiving the firearm to be held therein, said interior space being configured to generally conform to at least a portion of a peripheral shape of the firearm, whereby movement of the firearm within said interior of said holster pouch is constrained.

14. An integrated carrying bag, bag insert and firearm holster assembly comprising:

a carrying bag having a main interior compartment for receiving, holding, transporting items;

an organizer device for holding and concealing a firearm within said main interior compartment of said carrying bag, said organizer device comprising a bag insert for being received by and fitting within the main compartment of carrying bag, said bag insert including a peripheral wall that surrounds a main receptacle of said bag insert, and a holster attached to said peripheral wall of said bag insert, said holster having an interior holster chamber for receiving a firearm; and a holster pouch removably inserted and supported within said holster chamber, said holster pouch having an interior space configured to generally conform to at least a portion of a peripheral shape of the firearm, whereby movement of the firearm within said interior space of said holster pouch is constrained.

15. The assembly of claim 14 in which said holster chamber includes a first corner and said holster pouch includes a substantially conformably shaped second corner for interengaging said first corner to constrain movement of said holster pouch within said holster chamber.

16. The device of claim 15 in which said holster pouch includes bottom and side edges that define said second corner and a curved edge interconnecting said bottom and side edges, said curved edge having an access opening formed therein which access opening communicates with said interior space of said holster pouch for introducing the firearm into and removing the firearm from said pouch of said holster pouch.

17. The device of claim 14 in which said holster chamber includes an entrance and further comprising a closure that includes a flap flexibly attached to said holster for selectively uncovering said entrance to open said holster chamber and covering said entrance to close said holster chamber.

18. The device of claim 17 in which said closure includes complementary fastening elements carried by said flap and said holster that are selectively interengageable to close said holster pocket; said fasteners being disengaged for opening said holster.

* * * * *